US008011428B2

(12) United States Patent
Myerley et al.

(10) Patent No.: US 8,011,428 B2
(45) Date of Patent: Sep. 6, 2011

(54) DOWNHOLE DECELERATING DEVICE, SYSTEM AND METHOD

(75) Inventors: Thomas S. Myerley, Broken Arrow, OK (US); Michael J. May, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 152 days.

(21) Appl. No.: 12/277,385

(22) Filed: Nov. 25, 2008

(65) Prior Publication Data

US 2010/0126732 A1 May 27, 2010

(51) Int. Cl.
*E21B 23/00* (2006.01)
*E21B 23/01* (2006.01)

(52) U.S. Cl. ..... 166/209; 166/217; 166/382

(58) Field of Classification Search ..... 166/209–211, 166/217, 382
See application file for complete search history.

(56) References Cited

U.S. PATENT DOCUMENTS

| | | | | |
|---|---|---|---|---|
| 1,642,136 | A * | 9/1927 | Wilson | 166/211 |
| 1,673,802 | A * | 6/1928 | Crago | 166/211 |
| 3,002,564 | A | 10/1961 | Baker | |
| 3,077,933 | A | 2/1963 | Bigelow | |
| 4,223,746 | A | 9/1980 | Tanguy et al. | |
| 4,657,077 | A | 4/1987 | Smith, Jr. et al. | |
| 4,658,902 | A | 4/1987 | Wesson et al. | |
| 4,679,669 | A | 7/1987 | Kalb et al. | |
| 4,693,317 | A | 9/1987 | Edwards et al. | |
| 4,817,710 | A | 4/1989 | Edwards et al. | |
| 4,823,872 | A | 4/1989 | Hopmann | |
| 4,830,104 | A * | 5/1989 | Haley et al. | 166/214 |
| 4,932,471 | A | 6/1990 | Tucker et al. | |
| 5,083,623 | A | 1/1992 | Barrington | |
| 5,183,113 | A | 2/1993 | Leaney et al. | |
| 5,366,013 | A | 11/1994 | Edwards et al. | |
| 5,549,156 | A | 8/1996 | Borden | |
| 5,590,714 | A | 1/1997 | Van Steenwyk et al. | |
| 5,875,875 | A | 3/1999 | Knotts | |
| 6,109,355 | A | 8/2000 | Reid | |
| 6,454,012 | B1 | 9/2002 | Reid | |
| 6,708,761 | B2 | 3/2004 | George et al. | |
| 6,817,598 | B2 | 11/2004 | Parrott et al. | |
| 7,178,600 | B2 | 2/2007 | Luke et al. | |
| 7,296,638 | B2 | 11/2007 | Beach et al. | |
| 7,328,748 | B2 | 2/2008 | Giacomino | |
| 7,451,809 | B2 | 11/2008 | Noske et al. | |
| 7,779,908 | B2 | 8/2010 | Eriksson et al. | |
| 2004/0011533 | A1 * | 1/2004 | Lawrence et al. | 166/382 |

OTHER PUBLICATIONS

Wagner, Alan N., et al. "Downhole Shock Absorber with Crushable Nose," U.S. Appl. No. 12/054,592, filed Mar. 25, 2008. Specification having 10 pages, Figures having 1 sheet.

Worford, S.W., et al."Shock Absorbers—Are They Necessary?" IADC/SPE Drilling Conference, Feb. 20-23, 1983, New Orleans, Louisiana, Paper No. 11406-MS. "Energizer Intensifier: Acceleration Tool & Wireline Shock Absorber," Impact Selector, Inc., Copyright 2008, 2 pages. Retrieved online on Nov. 20, 2008 from: http://www.impactselector.com/products/pdf/EnerFlyer_English.pdf.

Isinger, Ron, "Considerations Given to Land Rig Design for Versatility of Operations", IADC/SPE 74453, Feb. 2002, 1-13.

* cited by examiner

*Primary Examiner* — Giovanna C Wright
(74) *Attorney, Agent, or Firm* — Steve Rosenbaltt

(57) ABSTRACT

Disclosed herein is a decelerating device. The device includes, a body movably engagable within a tubular, a mandrel longitudinally movably disposed at the body, and at least one deceleration element disposed at the body in operable communication with the mandrel such that longitudinal movement of the mandrel with respect to the body causes controlled radial movement of the at least one deceleration element to decelerate the decelerating device in relation to the downhole tubular.

20 Claims, 3 Drawing Sheets

DOWNHOLE DECELERATING DEVICE, SYSTEM AND METHOD

BACKGROUND

Shock absorbers are used in downhole applications to protect equipment in the well if a tool string is accidentally dropped. The kinetic energy of a falling string or other object is dissipated by a shock absorber to reduce or eliminate damage from the impact. The shock absorber typically reduces the impact on the equipment by dissipating energy of the impact in a crushable member. Such shock absorbers may simply distribute the loads of impact over a longer time period without reducing the total load borne by the downhole equipment. In view of the different applications and conditions found in various wellbores, prior art shock absorbing configurations are not always effective. Additional systems and methods that reduce the total load borne by the downhole equipment would be well received in the art.

BRIEF DESCRIPTION

Disclosed herein is a downhole decelerating system. The system includes, a downhole tubular, a decelerator assembly movably engaged within the downhole tubular, a mandrel longitudinally movably disposed at the decelerator assembly, and at least one element disposed at the decelerator assembly in operable communication with the mandrel such that longitudinal movement of the mandrel causes controlled radial movement of the at least one element to interact with the downhole tubular to decelerate the decelerator assembly in relation to the downhole tubular.

Further disclosed herein is a method of decelerating a tool dropped within a downhole tubular. The method includes, contacting a downhole structure with a mandrel of a decelerator assembly in operable communication with the dropped tool, longitudinally moving the mandrel relative to a body of the decelerator assembly in response to the contacting, definitively radially moving at least one element disposed at the body in response to the longitudinally moving, and decelerating engaging the downhole tubular with the definitively radially moving of the at least one element.

Further disclosed herein is a downhole decelerating device. The device includes, a body movably engagable within a downhole tubular, a mandrel longitudinally movably disposed at the body, and at least one deceleration element disposed at the body in operable communication with the mandrel such that longitudinal movement of the mandrel with respect to the body causes controlled radial movement of the at least one deceleration element to decelerate the decelerating device in relation to the downhole tubular.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
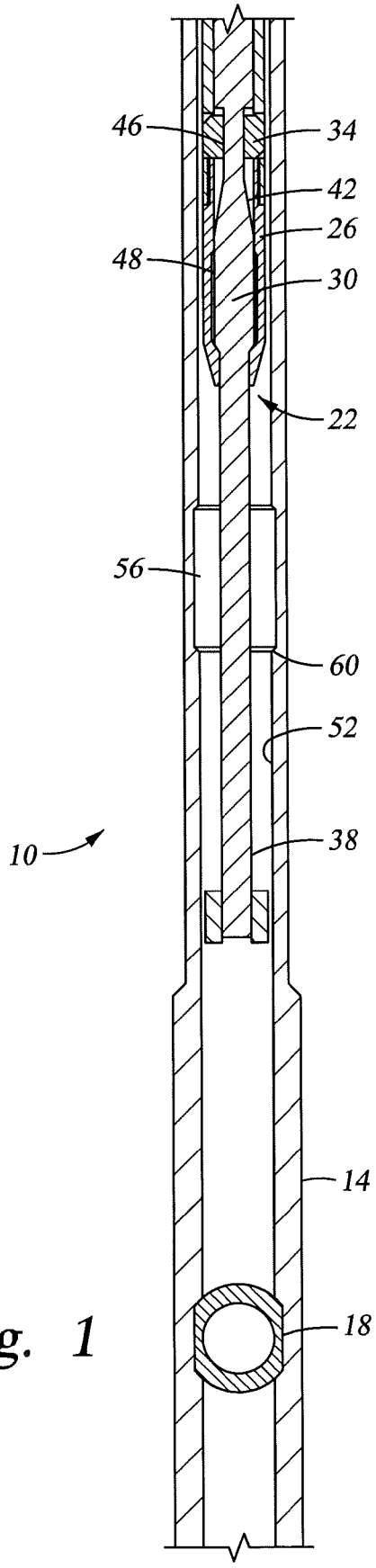
FIG. 1 depicts a cross sectional view of a decelerating system disclosed herein prior to impact.

Referring to FIG. 1, a decelerating system 10 disclosed herein is illustrated. The system 10 includes, a downhole tubular 14 with a downhole structure 18, depicted herein as a ball valve, positioned therein, and a decelerator assembly 22. In addition to the body 26, the decelerator assembly 22 includes, a mandrel 30 and at least one radially movable element 34 also referred to herein as a dog. A biasing member such as a tension spring (not shown) biases the dog(s) 34 radially inwardly toward the mandrel 30, which extends longitudinally beyond the dog(s) 34 in both directions. The mandrel 30 is longitudinally movable relative to the body 26, and the dog(s) 34, and has a distal end 38 that extends well beyond the body 26, in a downhole direction as illustrated herein. A tapered portion 42 of the mandrel 30 connects a first dimensioned portion 46 to a second dimensioned portion 48 of the mandrel 30. The first dimensioned portion 46 is radially smaller than the second dimensioned portion 48. Movement, therefore, of the mandrel 30 in an uphole direction relative to the dog(s) 34, and body 26, causes the dog(s) 34 to move radially outwardly as the dog(s) 34 ramps along the increasing radial dimension of the tapered portion 42.

Figure 2:
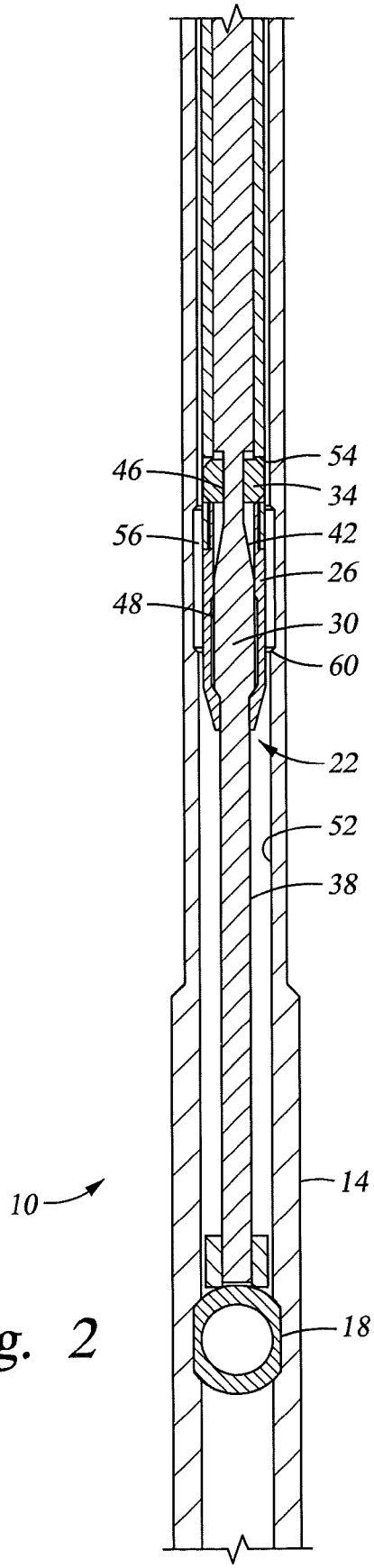
FIG. 2 depicts a cross sectional view of the decelerating system of FIG. 1 shown at an initial point of impact.
Figure 3:
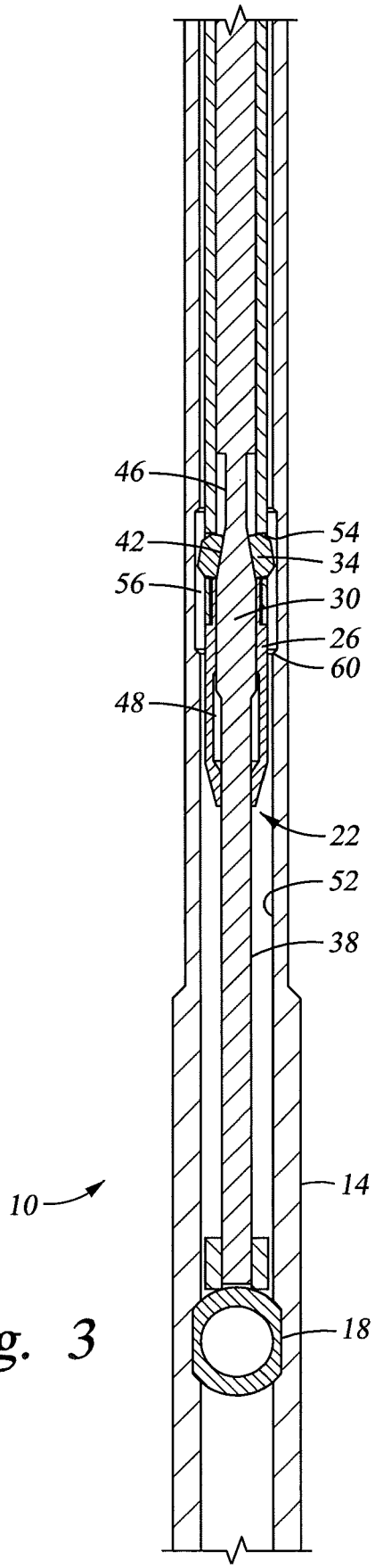
FIG. 3 depicts a cross sectional view of the decelerating system of FIG. 1 shown with dogs radially engaged with a recess of the downhole tubular.

Referring to FIGS. 2 and 3, a decelerator assembly 22 falls in a downhole direction within the tubular 14 until the distal end 38 of the mandrel 30 contacts the downhole structure 18, at which point the mandrel 30 ceases motion in relation to the tubular 14. Continued downward movement of the rest of the decelerator assembly 22 causes relative longitudinal motion between the body 26 and the mandrel 30. This relative motion causes the dog(s) 34 to ride along the tapered portion 42 of the mandrel 30 from the first dimensioned portion 46 toward the second dimensioned portion 48. In so doing the dog(s) 34 moves radially outwardly through windows 54 in the body 26 as the dog(s) 34 ramps along the tapered portion 42, as best seen in FIG. 3. As the dog(s) 34 travels radially outwardly it enters a recess 56 in an inner wall 52 of the downhole tubular 14.

Figure 4:
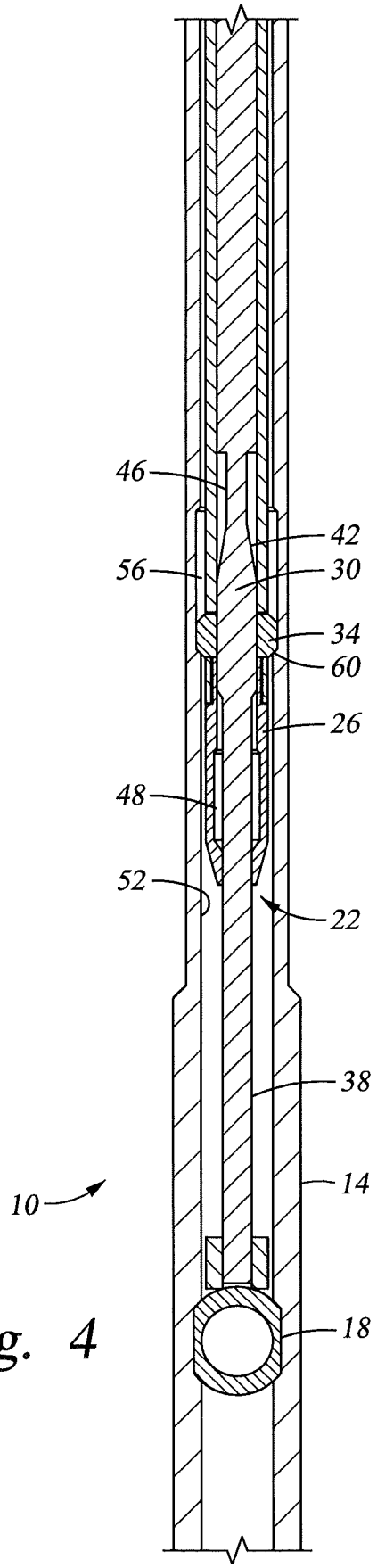
FIG. 4 depicts a cross sectional view of the decelerating system of FIG. 1 shown after motion of a decelerator assembly ceased with respect to the downhole tubular.

Referring to FIG. 4, downward velocity of the decelerator assembly 22 is decelerated until stopped by contact of the dog(s) 34 with an end 60 of the recess 56. Cessation of movement of the dog(s) 34 causes cessation of movement of the body 26 since the dog(s) 34 is engaged through the windows 54 in the body 26.

Through the foregoing structure, the decelerating system 10 is configured so that only the impact load of the mandrel 30 and deceleration thereof is bore by the downhole structure 18. The rest of the loads due to impact and deceleration of the decelerator assembly 22 are bore by the tubular 14 through contact between the dog(s) 34 and the end 60 of the recess 56. Damage to the downhole structure 18 can, therefore, be reduced or eliminated in comparison to the damage that could result if the full impact and deceleration loads of the dropped tool were permitted to be bore by the downhole structure 18 alone.

Figure 5:
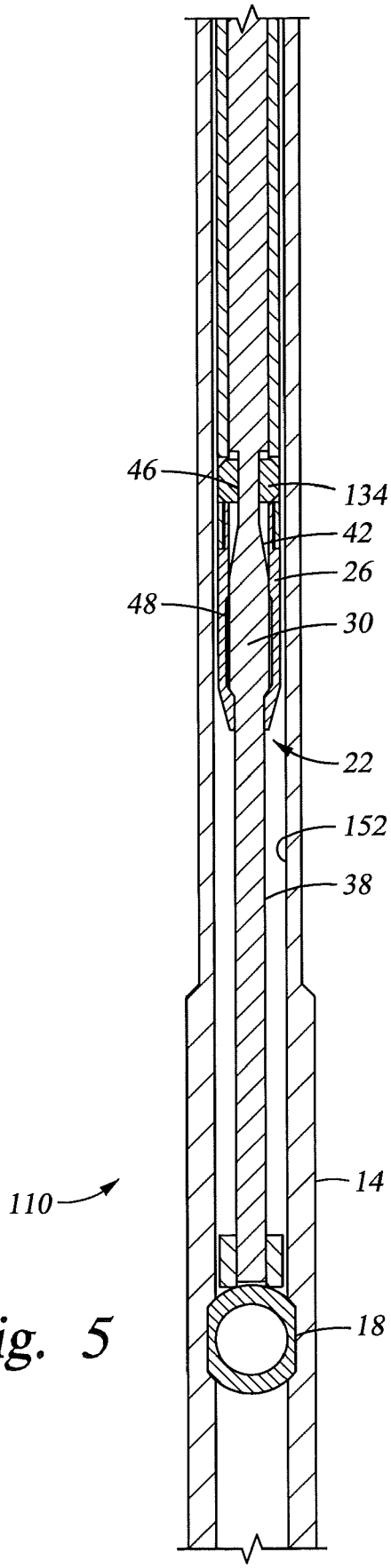
FIG. 5 depicts a cross sectional view of a decelerating device disclosed herein.

Referring to FIG. 5, an embodiment of a decelerating device 110 is illustrated with similar features to those illustrated in the decelerating system 10 above being designated with the same reference characters. Since the device 110 is similar to the decelerating assembly 22 only the primary difference of the device 110 will be detailed hereinbelow. The device 110 includes an inner wall 152 but does not include a recess 56 in the inner wall 152. In the device 110 the decelerator assembly 22 is decelerated and optionally stopped by engagement with the inner wall 152 directly. This engagement can take on different forms with a few alternatives being discussed herein.

In one embodiment at least one dog(s) 134 simply frictionally engages with the inner wall 152. Such frictional engagement can be aided by fabricating the dog(s) 134 out of a material that has a high coefficient of friction with the material from which the inner wall 152 of the tubular 14 is made. Alternately, the dog(s) 134 may include a coating or a shoe (not shown) attached thereto made of a material having a high friction coefficient.

In yet another embodiment, the dog(s) 134 may be configured to block fluidic flow between the decelerator assembly 22 and the inner wall 152 thereby hydraulically trapping fluid between the dog(s) 34 and the downhole structure 18 and forming a hydraulic brake. Additionally, a combination of more than one of the embodiments disclosed herein can be used in unison to decelerate the decelerator assembly 22 as well as any tools attached thereto when dropped within the downhole tubular 14.

Embodiments of the decelerating device 110 may be configured to decelerate and stop motion of the body 26 prior to impact between the body 26 and the downhole structure 18. Alternately, the decelerating device 110 may allow such contact only after sufficient kinetic energy has been dissipated to prevent damage to the downhole structure 18, the decelerator assembly 22, or the tool connected thereto.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A decelerating system for a tubular located at a subterranean location and further comprising a profile, comprising:

a decelerator assembly selectively actuated to engage the tubular;

said decelerator assembly movably mounted to a mandrel;

said decelerator assembly comprising at least one element in operable communication with the mandrel such that longitudinal movement of said decelerator assembly relative to said mandrel when said mandrel has found a support after freefalling causes radial movement of said at least one element to interact with the tubular to decelerate the decelerator assembly in relation to the tubular.

2. The decelerating system of claim 1, the tubular includes an inner wall with which the at least one element interacts.

3. The decelerating system of claim 1, wherein:

said element has a shape that conforms to the profile in the tubular to stop freefall of said decelerator assembly.

4. The decelerating system of claim 3, wherein:

the recess has an end against which the at least one element is stoppable.

5. The decelerating system of claim 1, wherein the at least one element is a dog configured to move radially outwardly in response to engagement with a tapered portion of the mandrel.

6. The decelerating system of claim 1, wherein the at least one element is frictionally engageable with an inner wall of the tubular.

7. The decelerating system of claim 1, wherein the decelerating system is configured to decelerate the decelerator assembly until relative movement between the decelerator assembly and the tubular ceases.

8. The decelerating system of claim 1, wherein the decelerator assembly is operably connectable to a tool.

9. A decelerating system for a tubular located at a subterranean location and further comprising a profile, comprising:

a decelerator assembly selectively actuated to engage the tubular;

said decelerator assembly movably mounted to a mandrel;

said decelerator assembly comprising at least one element in operable communication with the mandrel such that longitudinal movement of said decelerator assembly relative to said mandrel when said mandrel has found a support causes radial movement of said at least one element to interact with the tubular to decelerate the decelerator assembly in relation to the tubular; and said mandrel is movable relative to the decelerator assembly in response to contacting the profile within the tubular that is substantially stationary.

10. A decelerating system for a tubular located at a subterranean location and further comprising a profile, comprising:

a decelerator assembly selectively actuated to engage the tubular;

said decelerator assembly movably mounted to a mandrel;

said decelerator assembly comprising at least one element in operable communication with the mandrel such that longitudinal movement of said decelerator assembly relative to said mandrel when said mandrel has found a support causes radial movement of said at least one element to interact with the tubular to decelerate the decelerator assembly in relation to the tubular; and the at least one element restricts fluid flow between the decelerator assembly and the tubular in response to outward radial movement thereof.

11. A decelerating system for a tubular located at a subterranean location and further comprising a profile, comprising:

a decelerator assembly selectively actuated to engage the tubular;

said decelerator assembly movably mounted to a mandrel;

said decelerator assembly comprising at least one element in operable communication with the mandrel such that longitudinal movement of said decelerator assembly relative to said mandrel when said mandrel has found a support causes radial movement of said at least one element to interact with the tubular to decelerate the decelerator assembly in relation to the tubular; and the decelerating system is configured to cease movement of the decelerator assembly relative to the tubular prior to exhaustion of a stroke length of said decelerator assembly relative to said mandrel.

12. A method of decelerating a tool dropped within a tubular located at a subterranean location, comprising:

contacting a subterranean structure with a mandrel of a decelerator assembly in operable communication with the dropped tool;

creating relative longitudinal movement between the mandrel and a body of the decelerator assembly in response to the contacting;

radially moving at least one element disposed at the body in response to the relative longitudinal movement; and deceleratingly engaging the tubular with the radially moving of the at least one element.

13. The method of claim 12, further comprising:

engaging the at least one element with a recess in an inner wall of the downhole tubular.

14. The method of claim 12, wherein:

the deceleratingly engaging includes frictionally engaging the at least one element with an inner wall of the downhole tubular.

15. The method of claim 12, wherein:

the deceleratingly engaging includes restricting fluidic flow between the decelerator assembly and an inner wall of the downhole tubular.

16. The method of claim 12, further comprising:

ceasing relative motion between the decelerator assembly and the downhole structure.

17. The method of claim 16, wherein:

the ceasing relative motion is completed prior to exhausting the ability of the decelerator assembly to longitudinally move with respect to the mandrel.

18. The method of claim 12, wherein:

the radially moving includes ramping the at least one element radially outwardly against a tapered portion of the mandrel.

19. The method of claim 12, further comprising:

stopping movement of the mandrel relative to the downhole tubular with the contacting.

20. A decelerating device for a tubular at a subterranean location, comprising:

a body comprising a deceleration element and said body movably mounted to a mandrel, said deceleration element selectively engageable to the tubular;

and wherein longitudinal movement of said body relative to said mandrel when said mandrel has found a support after freefalling causes radial movement of said at least one deceleration element to decelerate said body in relation to the tubular.

* * * * *